United States Patent [19]

Shimomura et al.

[11] Patent Number: 4,773,837

[45] Date of Patent: Sep. 27, 1988

[54] SCREW PUMP

[75] Inventors: Atsushi Shimomura, Suma; Hitoshi Tsuihiji, Nishi; Yasuo Hirooka, Akashi, all of Japan

[73] Assignee: Kawasaki Jukogyo Kabushiki Kaisha, Chuo, Japan

[21] Appl. No.: 877,247

[22] Filed: Jun. 23, 1986

[30] Foreign Application Priority Data

Jun. 24, 1985 [JP] Japan ..... 60-138628

[51] Int. Cl.[4] ..... F04C 2/16; F04C 18/16

[52] U.S. Cl. ..... 418/180; 418/197

[58] Field of Search ..... 418/183, 186, 189, 190, 418/197, 180

[56] References Cited

U.S. PATENT DOCUMENTS

| | | | |
|---|---|---|---|
| 2,289,371 | 7/1942 | Lysholm | 418/190 |
| 2,601,003 | 6/1952 | Pontius | 418/190 |
| 2,620,968 | 12/1952 | Nilsson | 418/190 |
| 2,845,031 | 7/1958 | Guibert | 418/190 |
| 2,924,181 | 2/1960 | Sennet | 418/197 |
| 3,103,894 | 9/1963 | Sennet | 418/197 |

FOREIGN PATENT DOCUMENTS

| | | |
|---|---|---|
| 2824762 | 12/1979 | Fed. Rep. of Germany . |
| 36-9922 | 7/1961 | Japan . |
| 39-17791 | 8/1964 | Japan . |
| 1300867 | 3/1976 | United Kingdom . |

*Primary Examiner*—William L. Freeh

*Attorney, Agent, or Firm*—Marshall, O'Toole, Gerstein, Murray & Bicknell

[57] ABSTRACT

A screw pump including a screw assembly in a sleeve, the assembly comprising a drive screw having protruding threaded sides, and multiple driven screws having concave threaded sides which are closely meshed with the drive screw, thus forming a series of sealed chamber. The screw pump further includes one or more channels which are formed in the circumferential direction around the periphery of the driven screws, so that the final sealed chamber adjacent a discharge port of the pump partially communicates with the port through the channels shortly before the chamber completely opens to the port.

5 Claims, 9 Drawing Sheets

2
3
d
12
17
8
4
1
9
10
C
i'
8'
B
H
13
12'
2'
11'

3
8
2
1
2'
8'

2
12
3
17
8
4
i
C
H
13
14
11
B
10
1
d'
11'
2'

3
20
2
1
20'
2'

20
4
L
m
Z
d
12
3
2
1
9
10
C
B
H
13
i
i'
2'
12'
11'
20

3
2
1
2

20
4
11
i
13
H
m
Z
L
14
3
2
12
1
10
C
B
d'
2'
11'
20

SCREW PUMP

FIELD AND BACKGROUND OF THE INVENTION

This invention relates to a screw pump which transports a fluid from an intake port to a discharge port by the turning action of a screw assembly in a pump casing, the assembly forming fixed-capacity sealed chambers.

In this type of pump, normal manufacturing tolerances result in a small amount of leakage inside the pump casing, and this leakage causes the pressures of the multiple sealed chambers arranged along the screw assembly to gradually increase towards the discharge port. Thus, a differential pressure between chambers or closures, approximately equivalent to the value obtained by dividing the discharge pressure by the number of sealed chambers, is generated between the discharge port and the final sealed chamber which is adjacent to the discharge port.

Furthermore, a liquid being pumped inside the sealed chambers contains minute air bubbles, and/or when the sealed chamber closest to the intake port end is formed, the resulting empty space becomes filled with free gas and air bubbles, if the sealed chamber closes when it is not sufficiently filled with liquid. Because these air bubbles are suddenly exposed to high pressure when the final sealed chamber at the discharge end is opened, they are compressed and collapsed, thus causing cavitation erosion of the metal surfaces. This also generates noise and vibration, and further, it allows part of the pressurized fluid to flow from the discharge port back to the final sealed chamber. This phenomenon occurs each time the final sealed chamber opens to the discharge side, and thus results in a pulsation of the discharge port's pressure and discharge flow. The degree of this pulsation increases as the differential pressure increases between the discharge port and the final sealed chamber just prior to its opening.

For these reasons, screw pumps such as those described in Japanese Patent Publications No. 36-9922 published July 7, 1961 and No. 39-17791 published Aug. 25, 1964 have been proposed in order to suppress the aforementioned pulsation, noise, and vibration. The screw pump described in Patent Publication No. 36-9922 is constructed with a screw assembly consisting of a drive screw or power rotor having protruding or male threaded sides and two driven screws or idler rotors having concave threaded sides which are closely meshed with the drive screw. The screw assembly is closely fitted into a sleeve, thus forming sealed chambers. In this screw pump, as shown in FIG. 3 of the publication, an indentation 13 is provided on one side of the threads of at least one of the screws, for example the main or drive screw 1*a*. This indentation thus forms a spiralling passage through the entire screw assembly causing the pressure of the fluid chambers to gradually increase from the intake port pressure to the discharge port pressure. This in turn causes the air bubbles to be compressed gradually, thus making it possible to avoid the sudden collapsing of the air bubbles at the discharge port and to obtain smoother operation.

In the screw pump described in Patent Publication No. 39-17791, as shown in FIGS. 2 and 4, using some point between the intake end and the discharge end as a reference point, one or more V-shaped intersections of the passage housing the main screw and the passages housing the driven screws, inside the sleeve, are either cut at a slanting angle or are cut progressively larger either in the direction of the discharge end or in both directions thus forming channels which guide the fluid from the discharge end toward the intake end. This arrangement causes the pressure inside each sealed chamber to progressively increase as the chamber moves closer to the discharge end, thus gradually eliminating most of the air bubbles trapped inside the sealed chambers.

However, these solutions have not been entirely satisfactory. Because the screw pump described in Patent Publication No. 36-9922 requires a spiralling indentation to be formed along the entire length of the screw, and the screw pump described in Patent Publication No. 39-17791 requires tapered channels to be formed along the entire length, or almost the entire length, of the sleeve, fabrication of these pumps is a complicated process and production costs are high. Furthermore, fluid constantly flows from the discharge port toward the intake end, and there is an increased amount of leakage inside the pump. Thus, because there is a considerable amount of energy loss and because the amount of leakage increases as the pressure increases, these prior art pumps are not well suited for high-pressure operation.

It is the purpose of this invention to avoid the drawbacks described above. The purpose of this invention is to, by a relatively simple means, gradually increase the pressure of only the final sealed chamber adjacent to the open chamber in order to reduce the differential pressure between the final sealed chamber and the discharge port, thus greatly reducing the amount of pulsation, noise, and vibration, and thereby providing a screw pump which consumes less energy and which is well suited to high-pressure operation.

SUMMARY OF THE INVENTION

A screw pump including a screw assembly in a sleeve, the assembly comprising a drive screw having protruding threaded sides, and multiple driven screws having concave threaded sides which are closely meshed with the drive screw, thus forming a series of sealed chambers, the screw pump further including one or more channels which are formed in the circumferential direction around the periphery of the driven screws, so that the final sealed chamber adjacent a discharge port of the pump partially communicates with the port through the channels shortly before the chamber completely opens to the port.

BRIEF DESCRIPTION OF THE DRAWINGS

This invention will be better understood from the following detailed description taken in conjunction with the accompanying figures of the drawings, wherein.

DETAILED DESCRIPTION OF THE DRAWINGS

Figure 1:
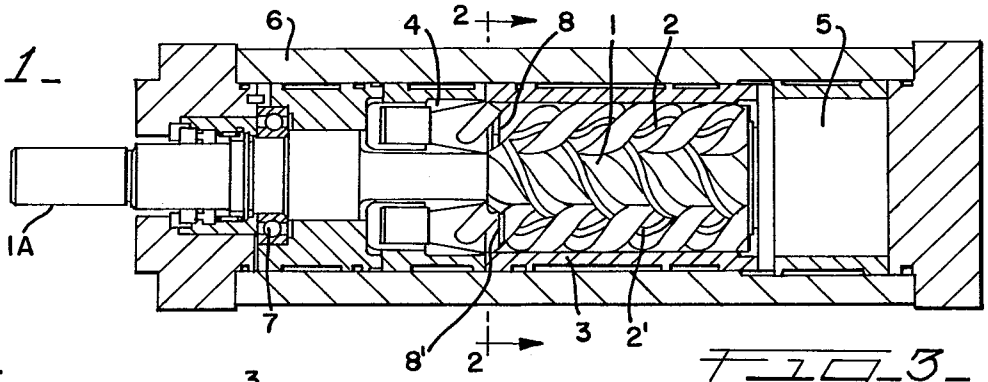
FIG. 1 shows a vertical cross-sectional view of the invention.
Figure 2:
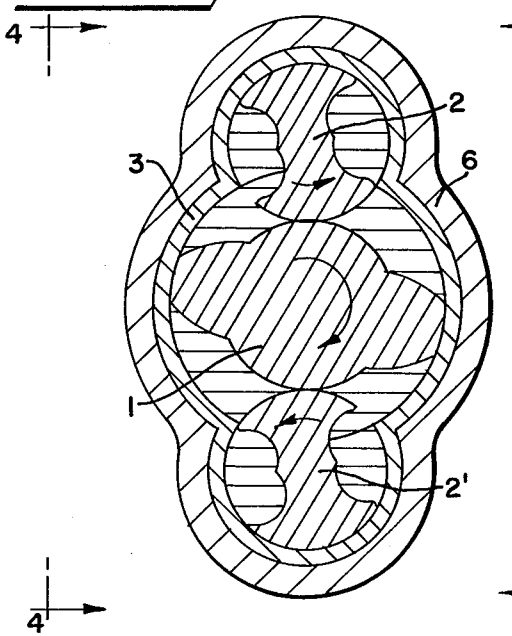
FIG. 2 shows a cross-sectional view taken along plane 2—2 in FIG. 1.

With reference to FIGS. 1–5, a screw pump according to this invention comprises a screw assembly including a double-threaded drive screw 1 having protruding screw threads 9 and 14, and a pair of double-threaded driven screws 2 and 2' located on opposite sides of the drive screw 1 and having concave screw grooves or channels. The channels are closely meshed with the threads of the drive screw 1, and this screw assembly is closely fit into a sleeve 3, thus forming sealed chambers. This sleeve 3 is mounted inside a casing 6 between a discharge port 4 and an intake port 5.

As shown in FIG. 1, one end 1*a* of the drive screw 1 is supported by a bearing 7 and protrudes out of the casing 6, and an appropriate drive source (not shown in the diagrams) is connected to drive this end. Thus, when the drive source is operated, the screws 1, 2 and 2' turn, and sealed chambers formed by the screws 1, 2 and 2' and the sleeve 3 move in the axial direction.

Figure 3:
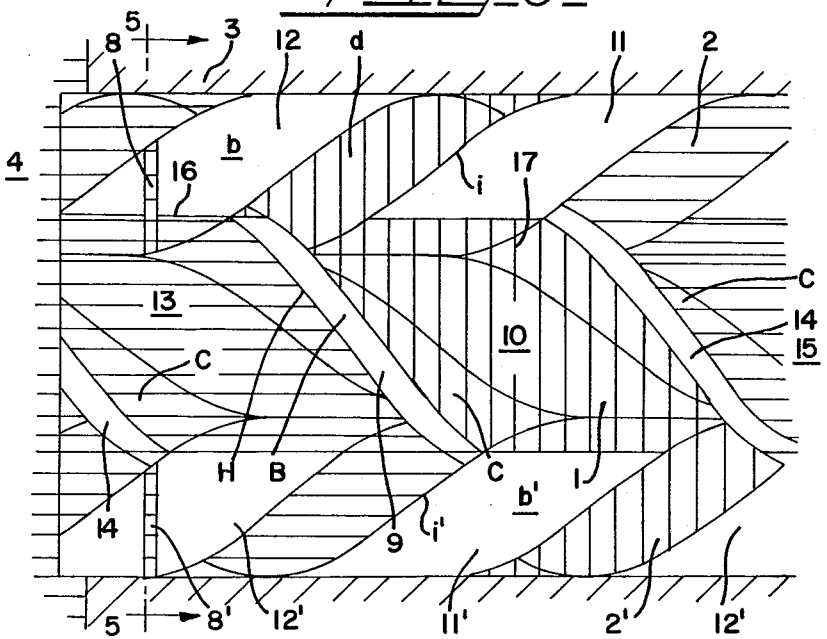
FIG. 3 shows a view taken from the line 3—3 in FIG. 2 of the screw engagement at the discharge end with the right half of the casing and the sleeve removed.
Figure 5:
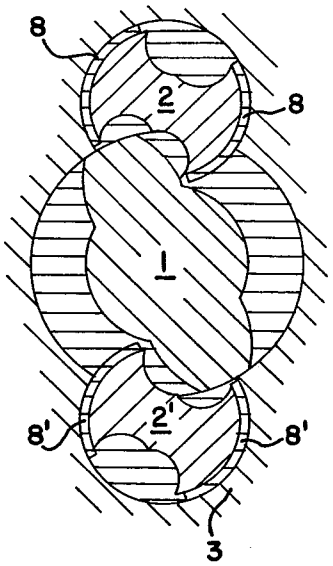
FIG. 5 shows a cross-sectional view taken along the lines 5—5 in FIGS. 3 and 4.
Figure 4:
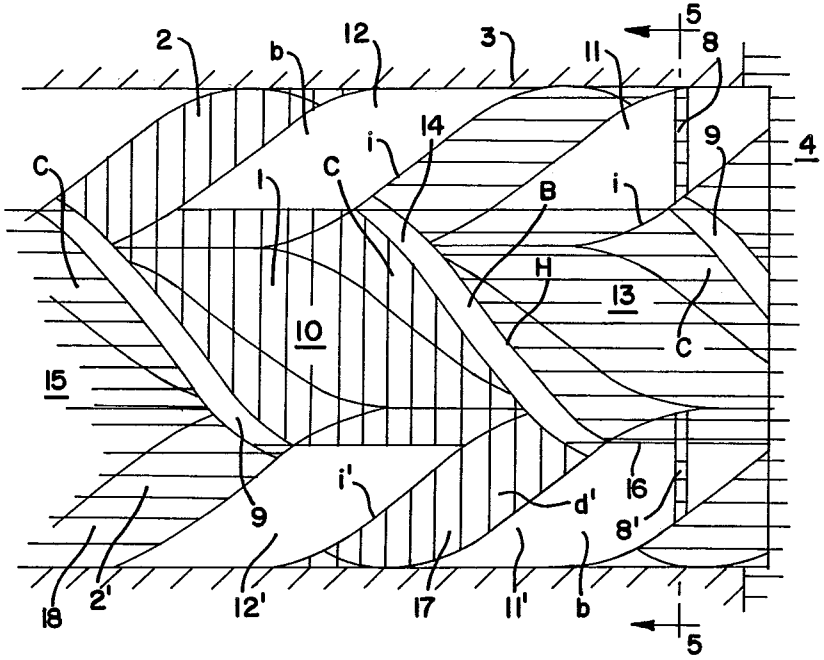
FIG. 4 shows a view from the direction line 4—4 in FIG. 2 of the screw engagement at the discharge end with the left half of the casing and the sleeve removed.

A series of chambers are axially spaced along the length of the screws, the chambers being formed between successive turns of the threads and the channels, and the sleeve 3. As the screws are rotated, the chambers are moved from the intake port to the outlet. In FIGS. 3, 4 and 5, the fluid in the chamber 13 which is open to the final discharge port 4 is represented by close horizontal lines 16; the fluid in the final sealed chamber 10, which is most closely adjacent the chamber 13, is indicated by close vertical lines 17, and the fluid in the sealed chamber 15 which is next adjacent the final sealed chamber 10 is indicated by the close horizontal lines 18. In the circumferential direction around the periphery of the threads of the driven screws, channels 8 in FIG. 4 (and 8' in FIG. 3) are formed so that both ends of the channels are constantly connected to the discharge port 4, and channels 8 in FIG. 3 (and 8' in FIG. 4) are formed to connect the discharge port 4 and the final sealed chamber 10.

The following is a description of the manner in which the final sealed chamber 10 is shut off from the open chamber 13 adjacent the discharge port 4. In FIG. 3, the final sealed chamber 10 is shut off from the open chamber 13 by the contact between the intake side C of the rib or thread 9 on one side of the double-threaded center drive screw 1, and the seal line i', which is the circumferential discharge edge of the thread 11' on one side of the double-threaded driven screw 2'; the contact between the circumferential surface B of the thread 9 of the drive screw 1, and also the seal line H which is the discharge edge of this circumferential surface B, and the intake side d of the thread 12 on the other side of the driven screw 2, and the contact between the sleeve 3 and the circumferential surfaces B, b and b' of the threads 9, 12 and 11' occurring between the open chamber 13 and the final sealed chamber 10. In FIG. 4, the final sealed chamber 10 is shut off from the ope chamber 13 by the contact between the intake side C of the thread 14 on the other side of the double-threaded drive screw 1 and the seal line i, which is the circumferential discharge edge of the thread 12 on the other side of the double-threaded driven screw 2, the contact between the circumferential surface B of the thread 14 of the drive screw 1, and also the seal line H which is the discharge edge of this circumferential surface B, and the intake side d' of the thread 11' of the driven screw 2, and the contact between the sleeve 3 and the circumferential surfaces B, b and b' of the threads 14, 12 and 11' occurring between the open chamber 13 and the final sealed chamber 10.

In addition, the final sealed chamber 10 is shut off from the sealed chamber 15 which is next adjacent to it on the intake side in the same manner as that just described above.

Meanwhile, in the state shown in FIGS. 2 through 5, the channels 8 and 8' in the driven screws 2 and 2' are open only to the open chamber 13, and these channels do not function to connect the open chamber 13 and the final sealed chamber 10. Thus, the final sealed chamber 10 is kept sealed and separated from the open chamber 13 and from the adjacent sealed chamber 15.

Note that, in FIGS. 3 and 4, the complete screw threads at the discharge port 4 end at the positions shown in the diagrams slightly protruding from the sleeve, and any parts protruding further than this are omitted from the diagrams.

Figures 6, 7, 8, 9:
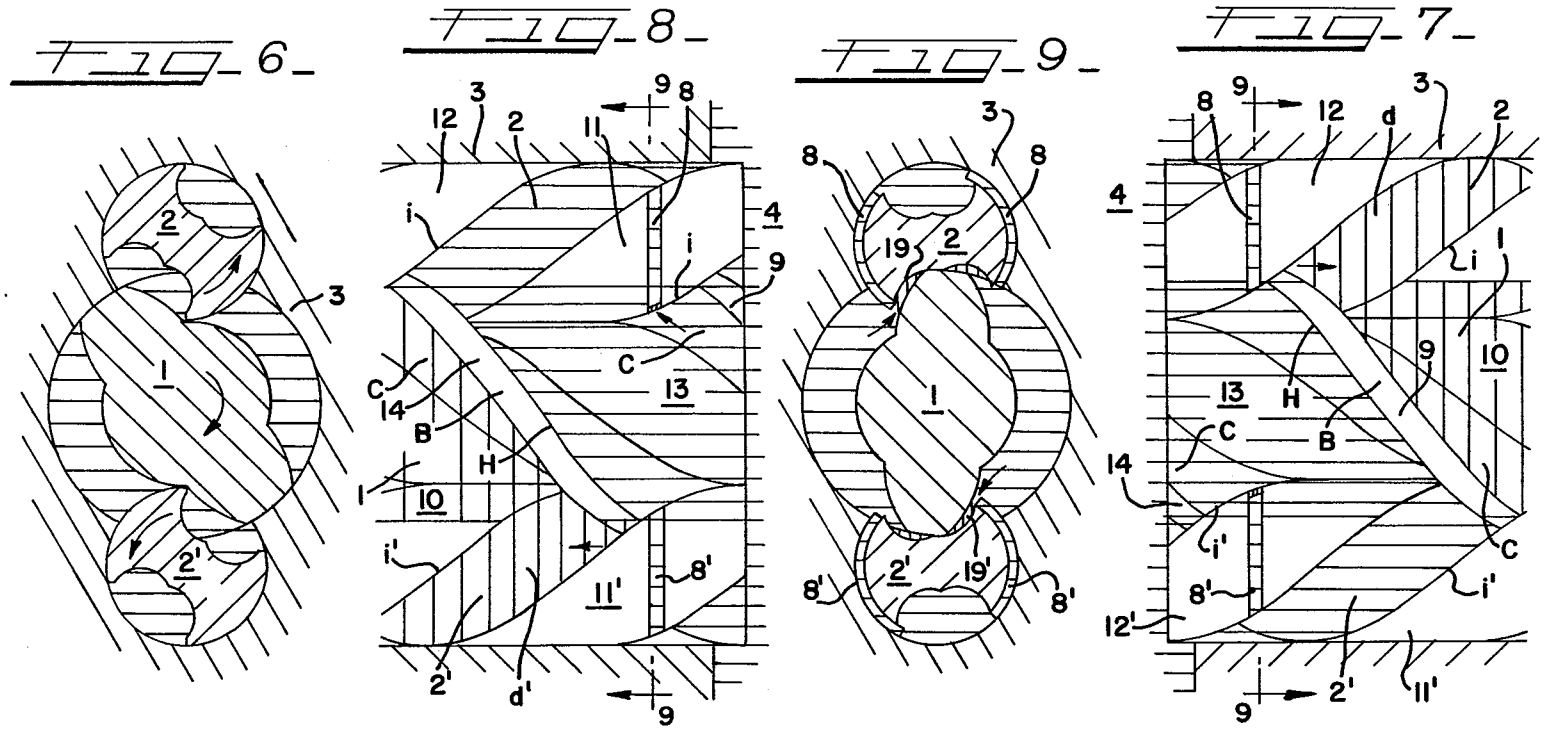
FIGS. 6, 7 and 8 are views similar to FIGS. 2, 3 and 4 and show the state where the screws have turned from the state shown in FIGS. 2, 3 and 4, and an part of the seal of the final sealed chamber has been broken.
FIG. 9 shows a cross-sectional view along the plane 9—9 in FIGS. 7 and 8.

During operation, as a result of the rotation of the screws 1, 2 and 2', the final sealed chamber 10, which in FIGS. 2 through 5 is in the sealed state, has moved toward the discharge end and changes to the state shown in FIGS. 6 through 9, although the channel 8 in FIG. 7 and the channel 8' in FIG. 8 connect only to the open chamber 13, the channel 8' in FIG. 7 notches the contact between side C of the thread 14 of the drive screw 1 and the seal line i' of the driven screw 2', and the channel 8 in FIG. 8 notches the contact between side C of the thread 9 of the drive screw 1 and the seal line i of the driven screw 2. As a result, the seals are broken at the notched locations, and, as shown in FIG. 9, the discharge pressure of the open chamber 13 is guided from the ends of the channels 8 and 8', via gaps 19 and 19', to the final sealed chamber 10. This state is the first-stage pressure increase, which causes the pressure of the final sealed chamber 10 to change from $P_e$to $P_e+\alpha_1$.

Figures 10, 11, 12, 13:
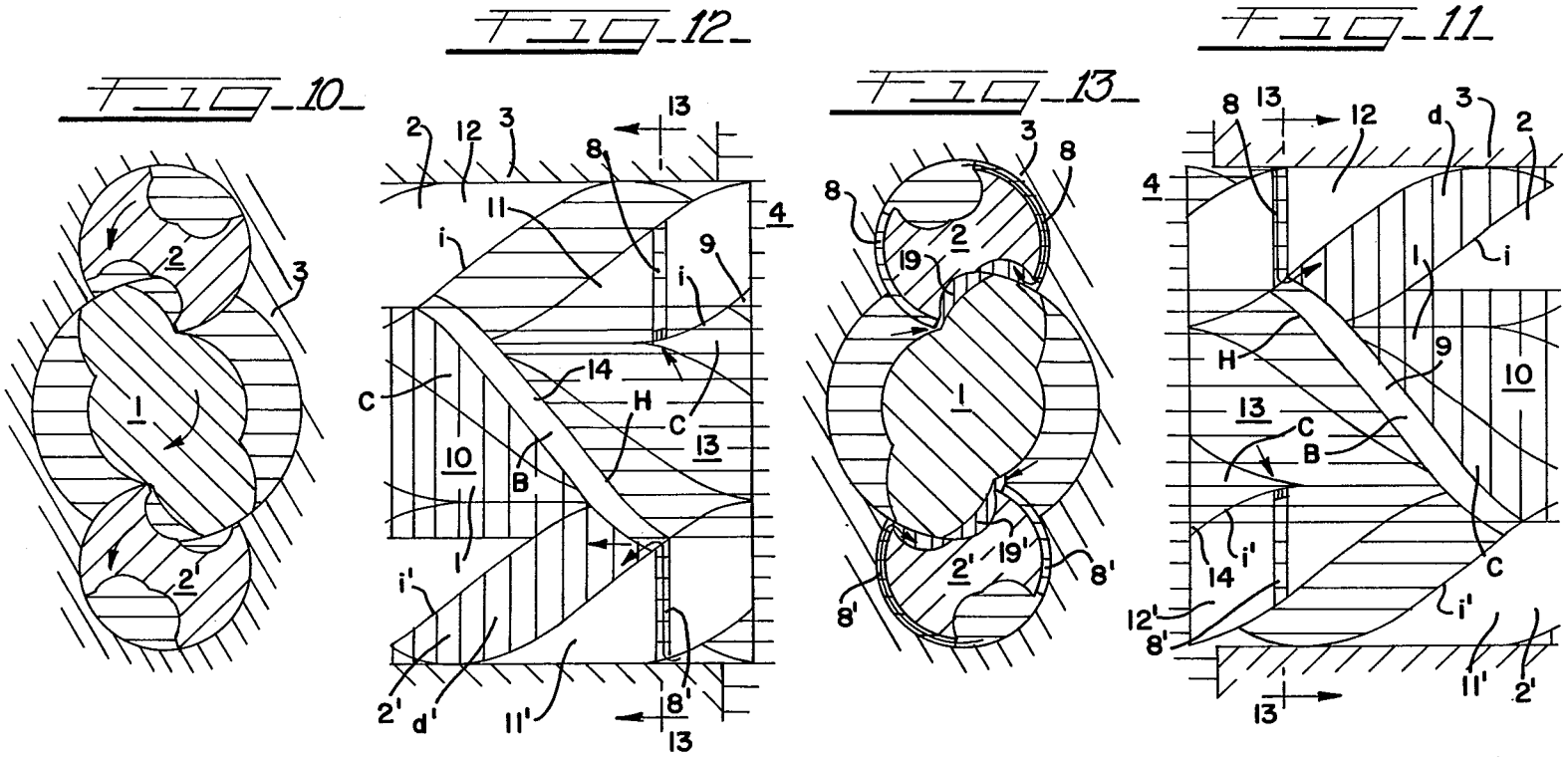
FIGS. 10, 11 and 12 are views similar to FIGS. 2, 3 and 4 and show the state where the screws have turned from the state shown in FIGS. 6, 7 and 8, and the opening of the seal of the final sealed chamber has progressed.
FIG. 13 shows a cross-sectional view along the plane 13—13 in FIGS. 11 and 12.
Figure 15:
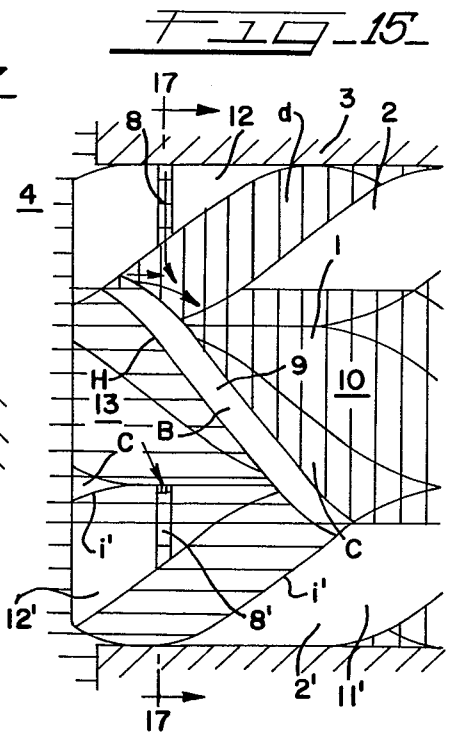
FIGS. 14, 15 and 16 are views similar to FIGS. 2, 3 and 4 and show the state where the screws have turned from the state shown in FIGS. 10, 11 and 12, and the pressure of the final sealed chanmber has become equivalent to the pressure of the discharge port.
Figure 17:
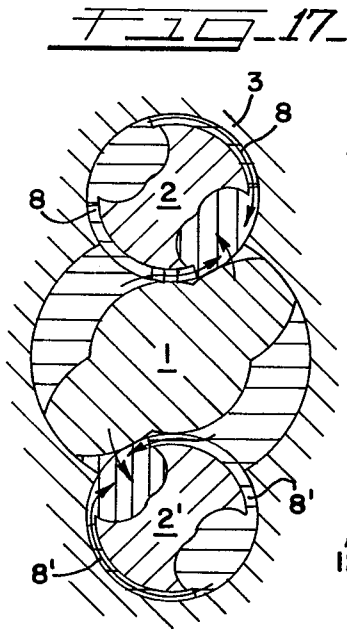
FIG. 17 shows a cross-sectional view along the plane 17—17 in FIGS. 15 and 16.
Figure 16:
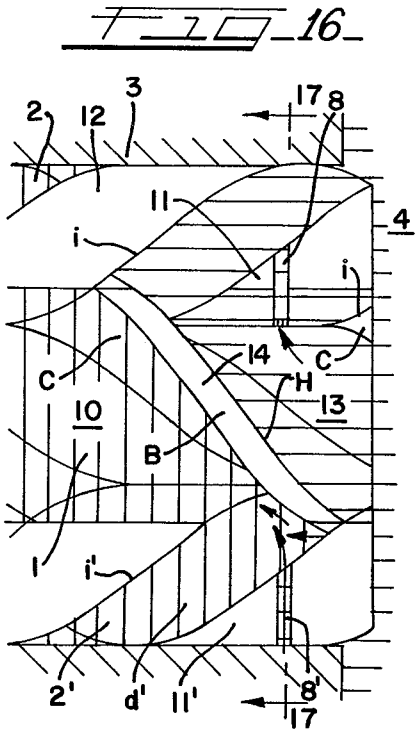

Next, when the revolution of the screws 1, 2 and 2' causes the final sealed chamber 10 to move further toward the discharge end and change to the state shown in FIGS. 10 through 13, in addition to the discharge pressure being guided via gaps 19 and 19' from the ends of the channel 8' in FIG. 11 and the channel 8 in FIG. 12 to the final sealed chamber 10, the channel 8 in FIG. 11 and the channel 8' in FIG. 12 connect the open chamber 13 with the final sealed chamber 10, thus allowing the discharge pressure to be guided to the final sealed chamber 10 via four routes. This state is the second-stage pressure increase, which causes the pressure of the final sealed chamber 10 to change from $P_e+\alpha_1$ to $P_e+\alpha_1+\alpha_2$.

Figure 14:
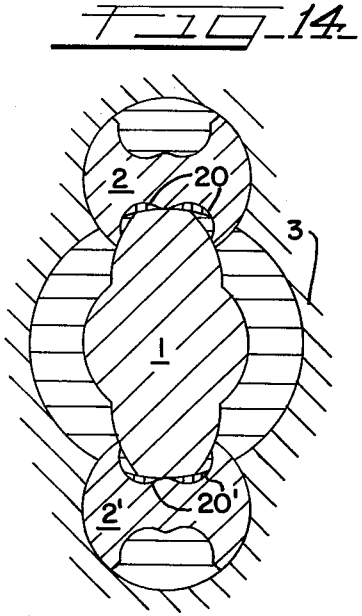

When the continued revolution of the screws 1, 2 and 2' causes the final sealed chamber 10 to move further toward the discharge end and change to the state shown in FIGS. 14 through 17, in addition to the discharge pressure being guided to the final sealed chamber 10 via the four routes mentioned above, looking at the thread ends facing the discharge port 4, the seal of the intake sides d and d' of the ends of threads 12 and 11' of the driven screws 2 and 2' and the circumferential surface B of the ends of the threads 9 and 14 of the drive screw 1 is broken, thus opening the final sealed chamber 10 to the discharge port 4. In other words, the discharge pressure is then guided from the crescent-shaped gaps 20 and 20' which, as shown in FIG. 14, appear at the ends of the threads between the drive screw 1 and the driven screws 2 and 2', to the final sealed chamber 10.

This state is the third-stage pressure increase, which causes the pressure of the final sealed chamber 10 to become equivalent to the discharge pressure, and, at the same time, the sealed chamber which was heretofore adjacent to the fina sealed chamber 10 then becomes the next final sealed chamber. This operation is continuously repeated.

The above description pertains to an embodiment in which the pressure of the final sealed chamber is increased to the level of the discharge pressure in three stages. However, by moving the positions of the channels 8 and 8' closer to the discharge port, the pressure of the final chamber 10 can be increased in two stages.

Figure 18:
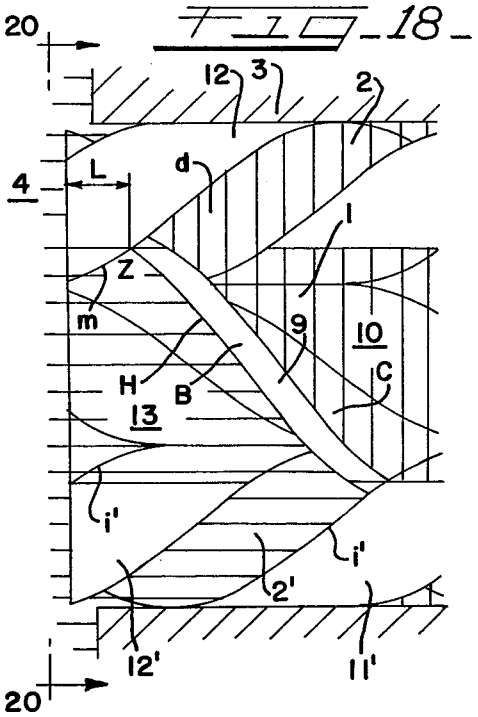
FIGS. 18 and 19 show another embodiment wherein the boundary between two-stage and three-stage pressure increases of the final sealed chamber.
Figure 20:
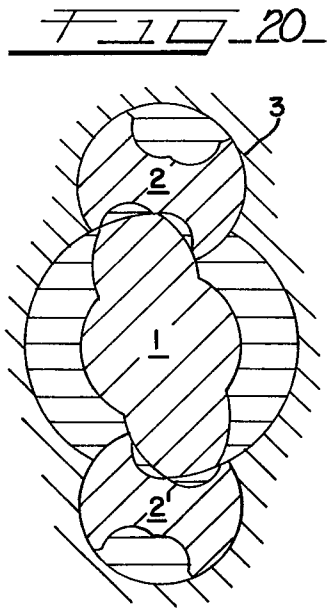
FIG. 20 shows a view from the direction of arrows 20—20 in FIGS. 18 and 19.
Figure 19:
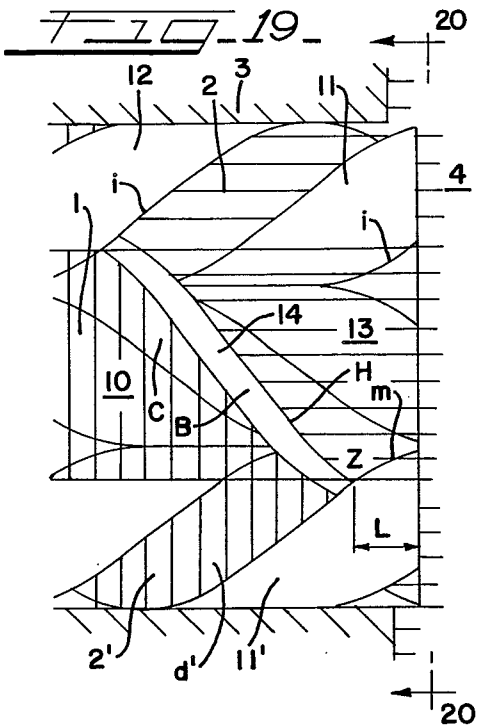

In other words, referring to FIGS. 18 through 20, when the final sealed chamber 10 is just opening to the discharge port 4, if the intersection point of the discharge edge H at the circumferential surface B of the threads 9 and 14 of the drive screw 1 and the intake edge m of the circumferential surface of the threads 12 and 11' of the driven screws 1 and 2' facing the open chamber 13 is point z, and if the channels 8 and 8' of the driven screws 2 and 2' are within the range of the distance L between this intersection point z and the ends of the threads, the pressure of the final chamber 10 is increased in two stages. If the intersection point is closer to the intake side than point z and both ends of at least one of the channels are constantly connected to the discharge port 4 with the other channel connecting the open chamber 13 and the final sealed chamber 10, the pressure is increased in three stages.

Figure 21:
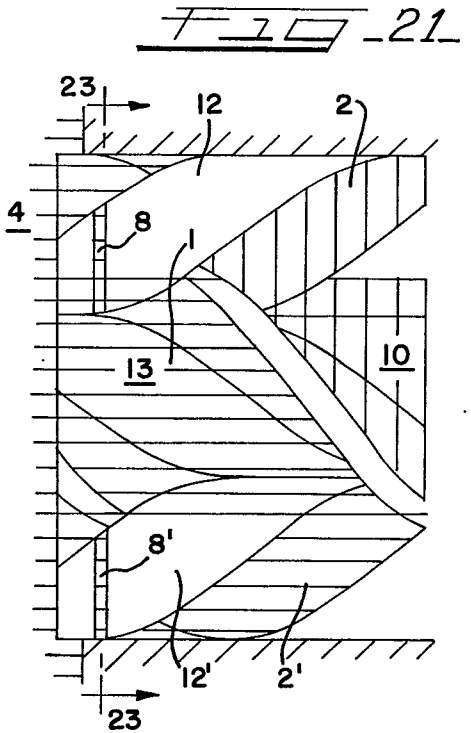
FIGS. 21 and 22 show side views of another embodiment wherein the screw engagement at the discharge end obtained with two-stage pressure increasing of the final sealed chamber.
Figure 23:
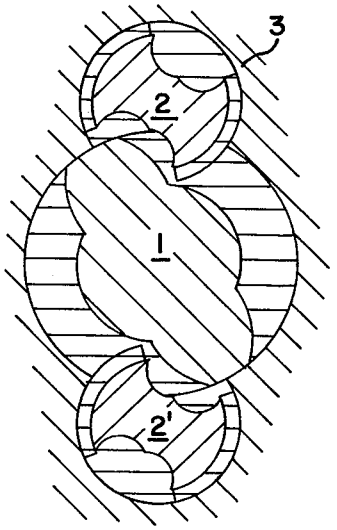
FIG. 23 is a cross-sectional view along the plane 23—23 in FIGS. 21 and 22.
Figure 22:
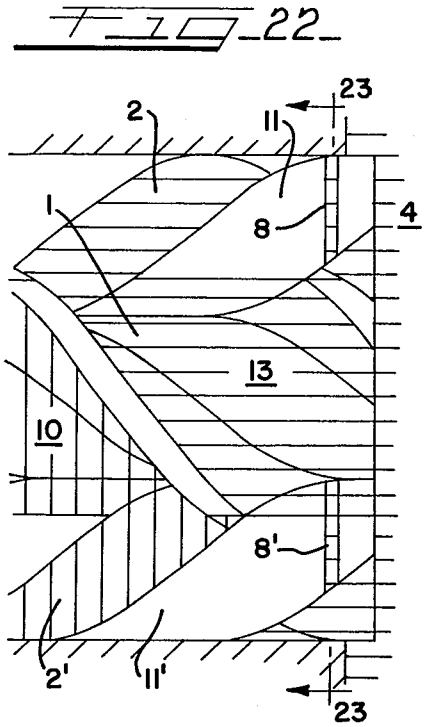
Figures 24, 25, 26, 27:
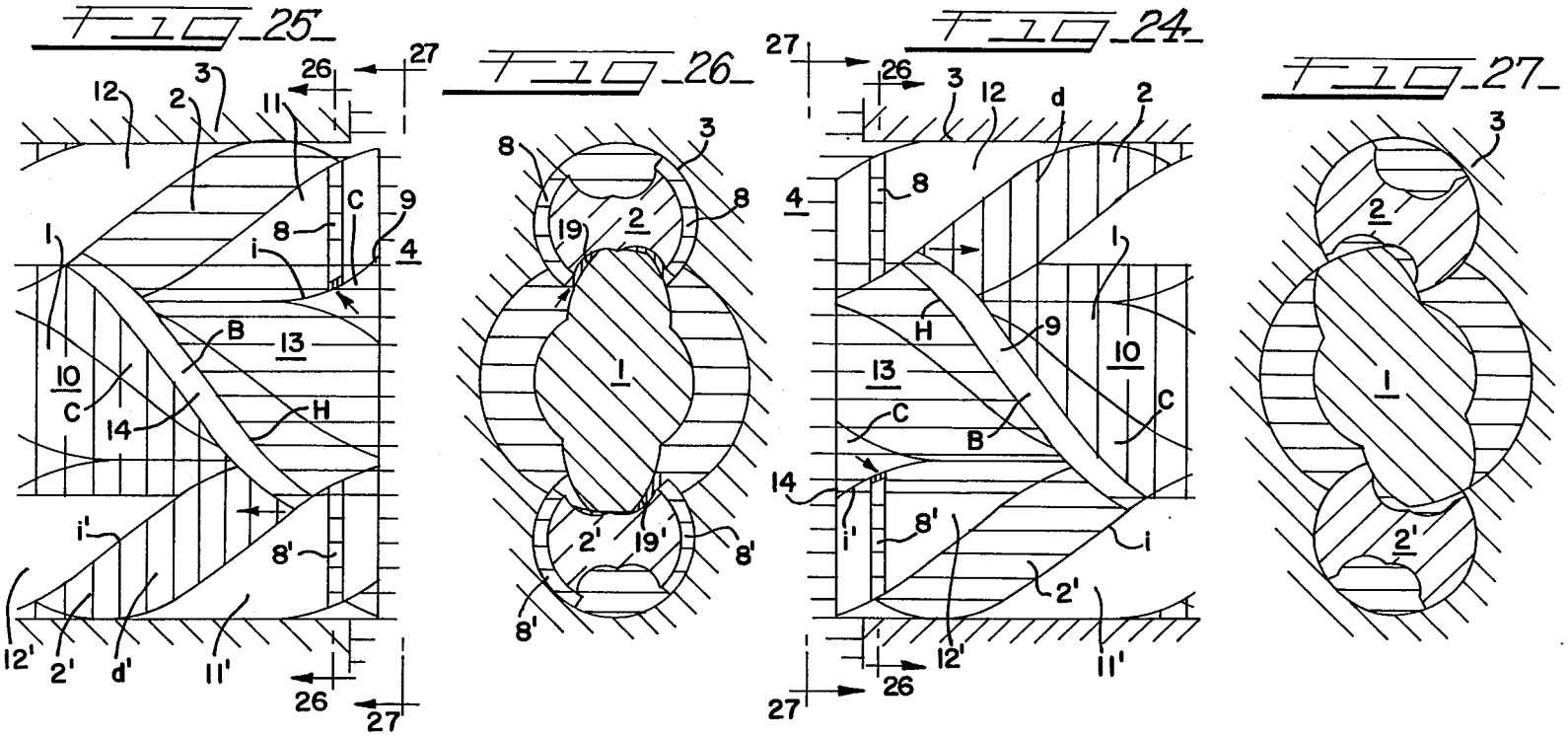
FIGS. 24 and 25 are further views of the embodiment of FIGS. 21–23, and show the state where the screws have turned from the state shown in FIGS. 21 and 22, and a part of the seal of the final sealed chamber has been broken.
FIG. 26 shows a cross-sectional view along the plane 26—26 in FIGS. 24 and 25.
FIG. 27 shows a view from the direction of arrows 27—27 in FIGS. 24 and 25.

FIGS. 21 through 23 show an embodiment where the channels 8 and 8' of the driven screws 2 and 2' are within the aforementioned distance L. When the final sealed chamber 10 changes from the state shown in FIGS. 21 through 23, where it is completely separated from the open chamber 13, the discharge port 4, and the sealed chamber adjacent it, to the state shown in FIGS. 24 through 27 as a result of the revolution of the screws 1, 2 and 2', although the channel 8 in FIG. 24 and the channel 8' in FIG. 25 are connected to only the open chamber 13, the channel 8' in FIG. 24 notches the contact between side C of the thread 14 of the drive screw 1 and the seal line i' of the thread 12' of the driven screw 2', and the channel 8 in FIG. 25 notches the contact between side C of the thread 9 of the drive screw 1 and the seal line i of the thread 11 of the driven screw 2. As a result, the seals are broken at the notched locations, and, as shown in FIG. 26, the discharge pressure of the open chamber 13 is guided from the ends of the channels 8 and 8', via gaps 19 and 19', to the final sealed chamber 10, thus causing the first-stage pressure increase of the final sealed chamber 10.

Figures 28, 29, 30, 31:
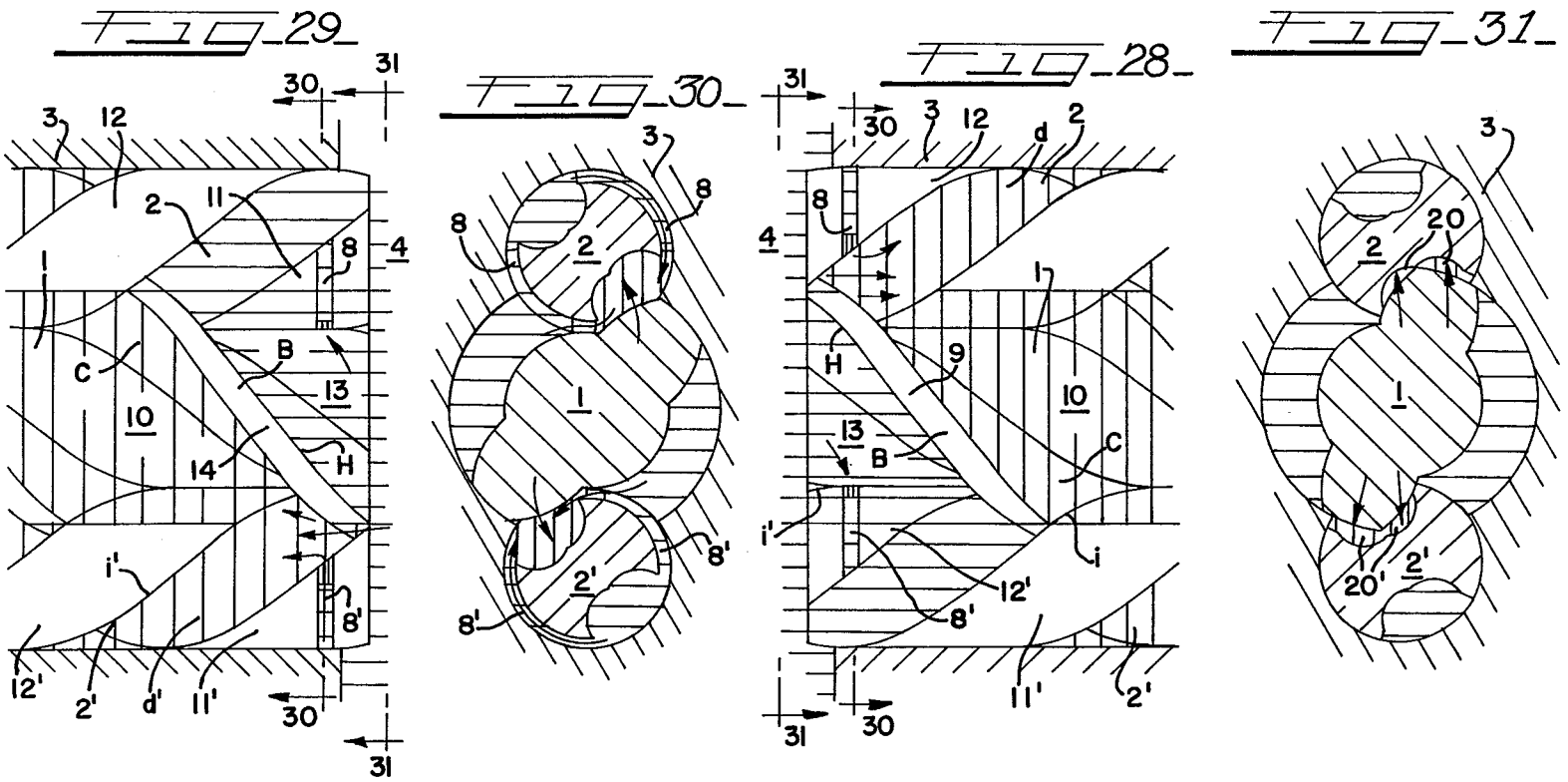
FIGS. 28 and 29 show the state where the screws have turned from the state shown in FIGS. 24 and 25, and the pressure of the final sealed chamber has become equivalent to the discharge pressure.
FIG. 30 shows a cross-sectional view along the plane 30—30 in FIGS. 28 and 29.
FIG. 31 shows a view from the direction of arrows 31—31 in FIGS. 28 and 29.

Next, referring to FIGS. 18 through 20, if the intersection point of the discharge edge H of the circumferential surface B of the threads 9 and 14 of the drive screw 1 and the intake edge m of the threads 12 and 11' of the driven screws 2 and 2' facing the open chamber 13 moves even slightly closer to the discharge side than point z, the final sealed chamber 10 is opened to the discharge port 4 via the gaps 20 and 20' (FIG. 14) in the thread ends. Because this opening of the final chamber 10 is considerably more dominant than the subsequent connecting of the open chamber 13 and the final sealed chamber 10 by the channels 8 and 8', the pressure increase is completed when this opening takes place. Thus, referring to FIGS. 28 through 31, because there is no increase in the pressure when the open chamber 13 and the final sealed chamber 10 are connected by the channel 8 in FIG. 28 and the channel 8' in FIG. 29, the pressure of the final sealed chamber is increased in substantially two stages.

Summarizing the operation of a pump according to the invention, when as a result of the revolution of the screws 1, 2 and 2', the final sealed chamber 10, which is in the sealed state as shown in FIGS. 2 through 5, moves toward the discharge side and changes to the state shown in FIGS. 6 through 9, because the channel 8' in FIG. 7 notches the contact between side C of the thread 14 of the drive screw 1 and the seal line i' of the driven screw 2', and the channel 8 in FIG. 8 notches the contact between side C of the thread 9 of the drive screw 1 and the seal line i of the driven screw 2, the discharge pressure of the open chamber 13 is guided, as shown in FIG. 9, from the ends of the channels 8 and 8', via gaps 19 and 19', to the final sealed chamber 10, thus causing the first-stage pressure increase of the final sealed chamber 10.

Furthermore, when the final sealed chamber 10 moves toward the discharge side and changes to the state shown in FIGS. 10 through 13, in addition to the aforementioned first-stage pressure increase, because the channel 8 in FIG. 11 and the channel 8' in FIG. 12 connect the open chamber 13 with the final sealed chamber 10, the final sealed chamber 10 also has a second-stage pressure increase.

When the final sealed chamber 10 moves further toward the discharge side and changes to the state shown in FIGS. 14 through 17, in addition to the aforementioned second-stage pressure increase, the seal of the intake sides d and d' of the threads 12 and 11' of the driven screws 2 and 2' facing the discharge port 4 and the circumferential surface B of the threads 9 and 14 of the drive screw 1 facing the discharge port 4 is broken. The discharge pressure is then guided from the crescent-shaped gaps 20 and 20' which, as shown in FIG. 14, appear at the ends of the screws between the drive screw 1 and the driven screws 2 and 2', to the final sealed chamber 10, thus causing the third-stage pressure increase of the final sealed chamber 10.

When this third-stage pressure increase is completed, the pressure of the final sealed chamber 10 is equivalent to the discharge pressure, and, at the same time, the sealed chamber which was heretofore adjacent to the final sealed chamber 10 then becomes the next final sealed chamber. This operation is continuously repeated.

The above description pertains to an embodiment in which the pressure of the final sealed chamber is increased to the level of the discharge port in three stages. However, referring to FIGS. 18 through 20, when the final sealed chamber 10 is just opening to the discharge port 4, if the intersection point of the discharge edge H of the circumferential surface B of the threads 9 and 14 of the drive screw 1 and the intake edge m of the circumferential surface of the threads 12 and 11', of the driven screws 2 and 2' facing the open chamber 13 is point z, and if the channels 8 and 8' of the driven screws 2 and 2' are within the range of the distance L between this intersection point z and the ends of the screws, the pressure of the final chamber 10 is increased in two stages.

In other words, when the final sealed chamber 10 changes from the sealed state shown in FIGS. 21 through 23 to the state shown in FIGS. 24 through 27 as a result of the revolution of the screws 1, 2 and 2', because channel 8' in FIG. 24 notches the contact between side C of the thread 14 of the drive screw 1 and the seal line i' of the driven screw 2', and the channel 8 in FIG. 25 notches the contact between side C of the thread 9 of the drive screw 1 and the seal line i of the driven screw 2, the discharge pressure of the open chamber 13 is guided, as shown in FIG. 26, from the ends of the channels 8 and 8', via gaps 19 and 19', to the final sealed chamber 10, thus causing the first-stage pressure increase of the final sealed chamber 10. However, because the channels 8 and 8' are located closer to the discharge side than point z shown in FIGS. 18 and 19, prior to the connecting of the discharge port 4 and the final sealed chamber 10 by the channel 8 in FIG. 24 and the channel 8' in FIG. 25, when the intersection point of the discharge edge H of the circumferential surface B of the threads 9 and 14 of the drive screw 1 and the intake edge m of the circumferential surface of the threads 12 and 11' of the driven screws 2 and 2' facing the open chamber 13 reaches point z, the final chamber 10 becomes open to the discharge port 4. Because this opening of the final chamber 10 is considerably more dominant than the connection made by the channels 8 and 8', the pressure increase is completed when this opening takes place, and the subsequent connecting of the discharge port 4 and the final sealed chamber 10 by the channel 8 in FIG. 24 and the channel 8' in FIG. 25 has no effect whatsoever. Thus the pressure of the final sealed chamber is increased in substantially two stages.

It will be apparent from the foregoing description that, because this invention provides for a gradual increase of the pressure of only the final sealed chamber, the differential pressure occurring when the final sealed chamber opens to the discharge port is reduced, thus making it possible to greatly reduce the amount of pulsation, noise, and vibration originating from the differential pressure. Moreover, because there is essentially no leakage other than that resulting from manufacturing tolerances in the various sealed chambers except the final one, this invention makes it possible to obtain a screw pump which has low energy-loss and which is well suited to high-pressure operation.

What is claimed is:

1. A screw pump comprising a screw assembly including a drive screw having protruding threaded sides and at least one driven screw having concave threaded sides which are closely meshed with said threaded sides of said drive screw, a sleeve, said screw assembly being closely fitted into said sleeve and thus forming a series of sealed chambers including a final sealed chamber, said sleeve and said assembly further having an intake port at one end thereof and a discharge port at the other end thereof, and at least one circumferentially extending channel formed in the peripheral surface of said driven screw, said channel extending entirely across said peripheral surface, whereby said final sealed chamber which is adjacent said discharge port partially communicates with said discharge port through said channel shortly before said final sealed chamber completely opens to said discharge port.

2. A screw pump comprising a screw assembly including a drive screw having protruding threaded sides, two driven screws having concave threaded sides which are closely meshed with said threaded sides of said drive screw, a sleeve, said screw assembly being closely fitted into said sleeve and thus forming a series of sealed chambers including a final sealed chamber, said sleeve and said assembly further having an intake port at one end thereof and a discharge port at the other end thereof, and at least one circumferentially extending channel formed in the peripheral surface of each of said driven screws, said channels extending entirely across said peripheral surface, whereby said final sealed chamber which is adjacent said discharge port partially communicate with said discharge port through said channel shortly before said final sealed chamber completely opens to said discharge port, said drive and driven screws having threads, said threads of each of said driven screws having said channels formed therein, said driven screws and said channels being offset relatively to each other such that said channels connect said final sealed chambers to said discharge port at different times.

3. A screw pump comprising a screw assembly including a drive screw having protruding threaded sides and at least one driven screw having protruding threads forming concave threaded sides which are closely meshed with said threaded sides of said drive screw, a sleeve, said screw assembly being closely fitted into said sleeve and thus forming a series of sealed chambers including a final sealed chamber, said sleee and said assembly further having an intake port at one end thereof and a discharge port at the other end thereof, and at least one channel formed in the peripheral surface of said threads of said driven screw, said channel extending in the circumferiential direction only and does not have a substantial radial component of direction and said channel extending entirely across said peripheral surface, whereby said final sealed chamber which is adjacent said discharge port partially communicates with said discharge port through said channel shortly before said final sealed chamber completely opens to said discharge port.

4. A screw pump according to claim 2, wherein said drive screw and said driven screws have double threads, and said channels are formed in both of said threads of each of said driven screws.

5. A screw pump according to claim 4, wherein said channels of both of said driven screws are aligned in a plane which is perpendicular to the axes of said screws.

* * * * *